US006089858A

United States Patent [19]

Loiselet et al.

[11] Patent Number: 6,089,858

[45] Date of Patent: Jul. 18, 2000

[54] DEVICE FOR PROTECTING THE INJECTION TIP OF A BURNER AND HEATING DEVICE COMPRISING IT

[75] Inventors: Benoît Loiselet, Bois d'Arcy; Philippe Beaudoin, Antony, both of France

[73] Assignee: L'air Liquide, Societe Anonyme pour l'Etude de l'Exploitation des Procedes Georges Claude, Paris, France

[21] Appl. No.: 09/319,248

[22] PCT Filed: Dec. 2, 1998

[86] PCT No.: PCT/PT98/00006

§ 371 Date: Jun. 8, 1999

§ 102(e) Date: Jun. 8, 1999

[87] PCT Pub. No.: WO99/28676

PCT Pub. Date: Jun. 10, 1999

[30] Foreign Application Priority Data

Dec. 1, 1997 [FR] France ..... 97 15089

[51] Int. Cl.[7] ..... F23C 5/06

[52] U.S. Cl. ..... 431/186; 431/155; 431/189

[58] Field of Search ..... 431/166, 153, 431/154, 159, 186, 189, 350, 353, 185

[56] References Cited

U.S. PATENT DOCUMENTS

| | | | |
|---|---|---|---|
| 1,930,812 | 10/1933 | Kunitz | 431/166 |
| 4,726,763 | 2/1988 | Newman | 431/353 |
| 4,986,748 | 1/1991 | Brown et al. . | |
| 5,267,850 | 12/1993 | Hisashi et al. . | |
| 5,785,721 | 7/1998 | Duane . | |

FOREIGN PATENT DOCUMENTS

| | | |
|---|---|---|
| 362997 | 4/1990 | European Pat. Off. . |
| 0582521 | 2/1994 | European Pat. Off. . |
| 2280501 | 2/1995 | United Kingdom . |

*Primary Examiner*—James C. Yeung
*Attorney, Agent, or Firm*—Nixon Peabody LLP; Robert M. Schulman

[57] ABSTRACT

Device for protecting an ejection outlet of a burner mounted through a wall of a furnace, comprising a peripheral heat shield around the ejection outlet of the burner comprising a consumable structure comprising a refractory material and a mounting for heat shield comprising a mover which moves the heat shield relative to the wall of the furnace, between at least two positions which are spaced apart along the axis of the burner.

9 Claims, 3 Drawing Sheets

DEVICE FOR PROTECTING THE INJECTION TIP OF A BURNER AND HEATING DEVICE COMPRISING IT

BACKGROUND OF THE INVENTION (i) Field of the Invention

The present invention relates to a device for protecting an ejection outlet of a burner mounted through a wall of a furnace, of the type comprising a peripheral heat shield and means of mounting the said heat shield around the ejection outlet of the burner.

The invention also relates to a heating device comprising a burner and a protection device of the aforementioned type.

(ii) Description of Related Art

In certain applications, such as, for example, in rotary iron-smelting furnaces, the burners used suffer greatly, on the one hand on account of the thermal radiation and, on the other hand, on account of the chemical attack caused by the substances that result from the smelting of the iron. In this type of furnace, it is known practice to provide means for water-cooling the ejection tip of the burner. These cooling means comprise a tubular protection member through which cooling water flows. This tubular member is mounted axially at the tip of the burner and projects into the furnace.

Such an arrangement is somewhat impractical because it requires the installation of a costly and bulky piece of equipment designed to allow water to flow through the protection member. Furthermore, the presence of a water circuit runs the risk of the circuit bursting if the furnace is shut down when the temperature is below 0° C.

SUMMARY AND OBJECTS OF THE INVENTION

The object of the invention is to propose a device for protecting the ejection outlet of a burner and a heating device comprising it, which do not have the drawbacks mentioned hereinabove, and which makes it possible to dispense with the use of a water circuit which is bulky and the cause of malfunctions.

To this end, the subject of the invention is a device for protecting an ejection outlet of a burner, of the aforementioned type, characterized in that the heat shield has a consumable structure made of refractory material and the said mounting means comprise means of moving the heat shield relative to the wall of the furnace, between at least two positions which are spaced apart along the axis of the burner.

According to particular embodiments, the protection device has one or more of the following characteristics:

- the mounting means are arranged between the burner and the heat shield, such that the heat shield is borne by the burner;
- the burner comprises a jacket containing pipes conveying the fuel and the oxidizing agent, which jacket is tubular over at least part of its length, and the movement means comprise a guide member pushed over the tubular part of the jacket, so as to allow the heat shield to slide along the jacket;
- the guide member is equipped with two coupled flanges trapping a gripping O-ring pressed against the exterior surface of the tubular part of the jacket, and means of clamping the two flanges together so as to compress the O-ring, thus keeping the heat shield in position relative to the jacket of the burner;
- the refractory material of which the structure is made is an aluminosilicate containing, by mass, x % of $SiO_2$ and y % of $Al_2O_3$ with an x/y ratio of between one third and two thirds and, in particular, close to one half;
- the sum x+y of the percentages by mass of $SiO_2$ and $Al_2O_3$ exceeds 90%; and
- the structure is a ramming mass which, prior to mounting, has been baked at a temperature in excess of 1000° C.

Another subject of the invention is a heating device comprising a burner associated with a protection device as defined hereinabove.

The invention will be better understood from reading the description which will follow, given merely by way of example and made with reference to the drawings.

DETAILED DESCRIPTION OF PREFERRED EMBODIMENTS

Figure 1:
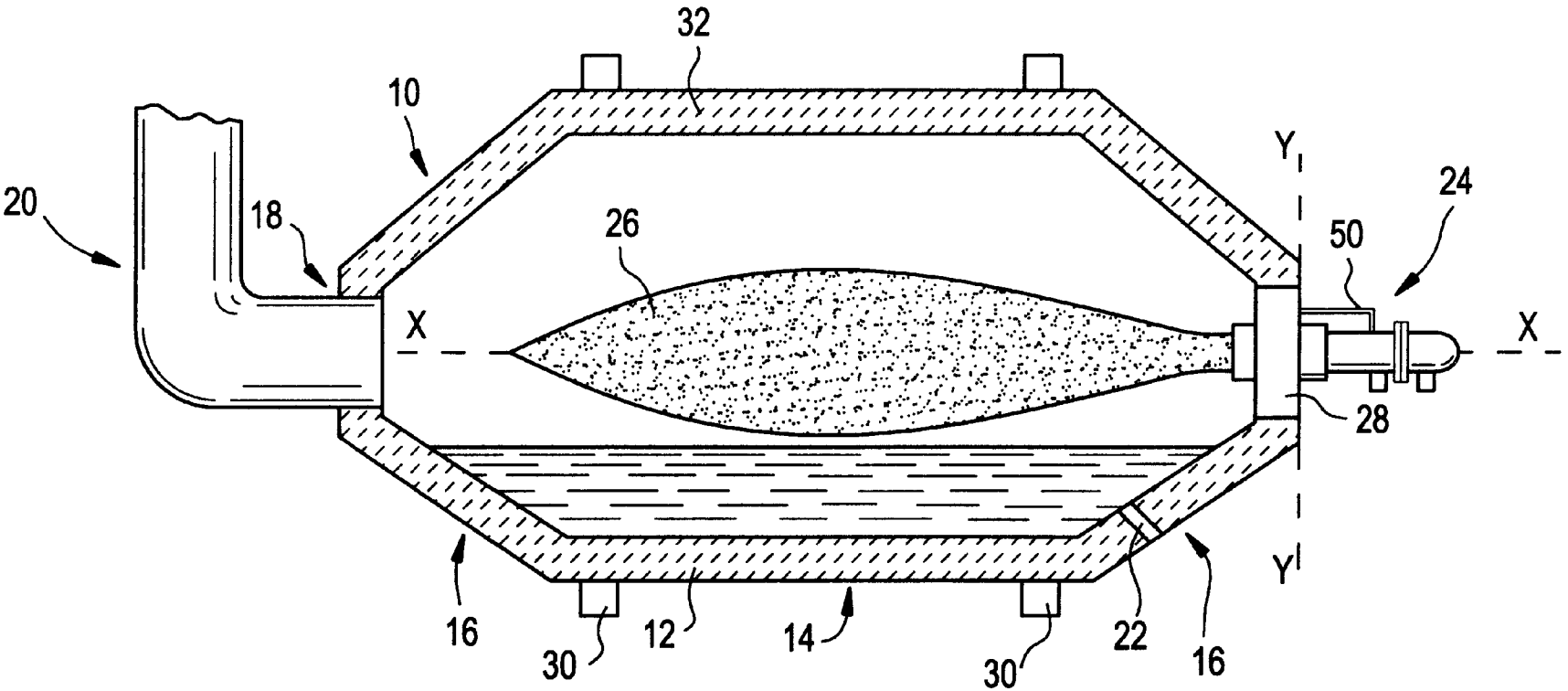
FIG. 1 is a diagrammatic view in longitudinal section of a rotary irons-melting furnace equipped with a burner according to the invention.

Depicted in FIG. 1 is a rotary iron-smelting furnace 10 equipped with a burner according to the invention. The furnace comprises a chamber 12 with a horizontal axis of rotation denoted X—X. The chamber 12 is delimited along its main part by a cylindrical wall 14 which, at each end 16, has frustroconical closure walls. At one end 18, the furnace comprises, axially, means 20 for charging the metals that are to be melted. At its other end, it comprises an outlet 22 for the molten iron.

Arranged along the axis X—X at the opposite end to the end 18 via which the materials to be melted arrive, there is a burner 24 designed to produce a flame 26 along the axis of the furnace. The burner 24 is borne by a furnace-closure hatch 28 articulated about a vertical axis Y—Y. The furnace is supported along its main part by two rings of rollers 30. It also comprises means, not depicted, for rotating it.

The interior wall of the furnace is covered with a silica-rich refractory lining 32 containing about 95% by weight of $SiO_2$ and 4% by weight of $Al_2O_3$, the rest consisting of impurities.

Figure 2:
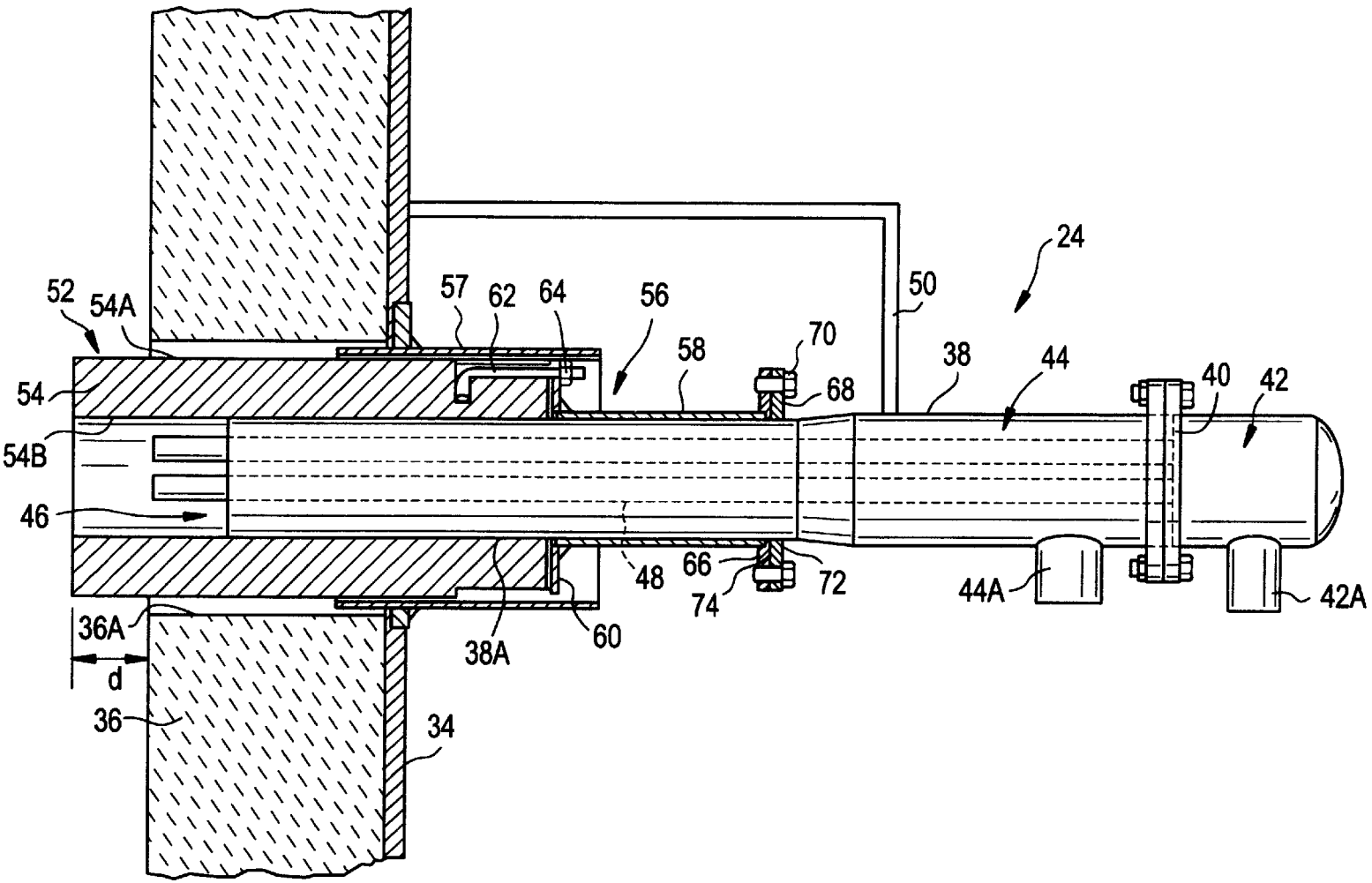
FIG. 2 is a view in longitudinal section of a burner associated with a new protecting device according to the invention.
Figure 3:
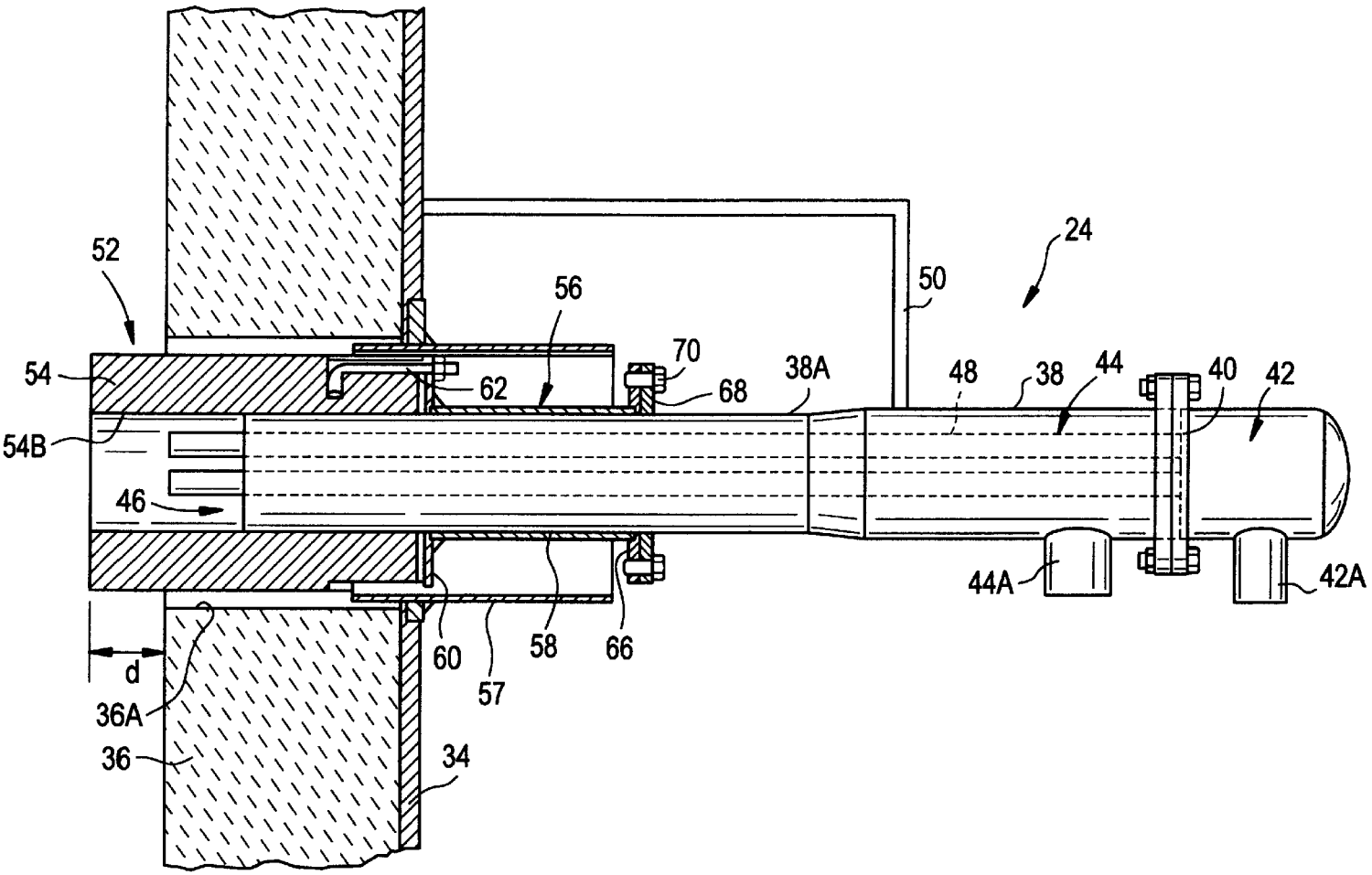
FIG. 3 is a view in longitudinal section of the burner of FIG. 1 associated with a protecting device according to the invention which has already been operating for a lengthy period.

The burner mounted on the hatch is depicted on a larger scale in FIGS. 2 and 3.

The hatch comprises an exterior metal wall 34 internally lined with a refractory material 36 similar to the lining 32 used for the interior wall of the furnace.

The burner comprises, in the conventional way, a jacket or body 38, generally with symmetry of revolution. The jacket is partitioned by a transverse wall 40 delimiting inside it an inlet chamber for the fuel gas 42, arranged at the rear, and an inlet chamber for the oxidizing gas 44. The latter chamber opens directly into the furnace via an opening 46 at the front end of the body. Each chamber 42, 44 is connected to a corresponding source for supplying gas, by a lateral tapping denoted 42A and 44A respectively.

The fuel gas inlet chamber 42 communicates with three fuel-gas injection lances 48. These lances pass through the wall 40 and are borne thereby. They extend into the jacket 38 along the axis of the burner and project beyond the opening 46.

The burner jacket 38 is rigidly connected to the plate 34 of the hatch by a support frame 50 depicted diagrammatically in the figures.

Furthermore, according to the invention, the burner is associated with a device 52 for protecting the injection outlet of the burner. This device 52 essentially comprises a heat shield 54 borne by its means 56 of mounting, on the main cylindrical part, denoted 38A, of the jacket.

The heat shield 54 is formed of a tubular member or sleeve. Thus, it has an external cylindrical surface labeled 54A and an internal cylindrical passage 54B. The diameter of the latter is constant and very slightly greater than the outside diameter of the main part 38A of the burner body. The ejection outlet of the burner, to which the ends of the lances 48 and of the chamber 44 open, is housed in the passage 54B, the sleeve being partially engaged over the main part 38A of the body.

The sleeve thus passes through the lining 36 of the hatch through a cylindrical opening 36A. A skirt 57 for protecting the heat shield, this skirt being formed of a tubular wall, extends the cylindrical opening 36A and projects out from the furnace. The skirt 57 is secured to the wall 34.

The sleeve 54 projects into the furnace at a front end by a distance of 7 cm. Its rear end projects out from the furnace beyond the plate 34 of the hatch. This rear end is secured to the mounting means 36.

The sleeve 54 is formed of a ramming mass which, prior to being assembled with the mounting means 56, has been baked at a temperature in excess of 1000° C.

The refractory material of which the sleeve 54 is made is an aluminosilicate advantageously containing, by mass, x % of $SiO_2$ and y % of $Al_2O_3$, the x/y ratio being between one third and two thirds and advantageously close to a half.

Furthermore, the sum x+y of the percentages by mass of $SiO_2$ and $Al_2O_3$ exceeds 90%.

The following table describes, by way of example, the composition of the sleeve 5 analyzed by an X-ray fluorescence method. The sleeve was analyzed after use in a furnace. The composition was determined at three distinct points on the sleeve, located as follows:

OUTER SURFACE: the part of the sleeve that projects into the furnace, excluding the front and face;

INNER SURFACE: the main part of the sleeve, particularly in its rear region;

SOILING: the front end face of the sleeve, that is to say the annular part being degraded at the front of the sleeve.

| | RESULTS IN % | | |
|---|---|---|---|
| ELEMENT | OUTER SURFACE | INNER SURFACE | SOILING |
| $SiO_2$ | 47.20 | 47.38 | 30.43 |
| $Al_2O_3$ | 45.97 | 46.23 | 37.58 |
| $FeO_3$ total | 1.49 | 1.47 | 28.33 |
| $P_2O_5$ | 2.50 | 2.18 | 1.19 |
| $TiO_2$ | 1.21 | 1.21 | 0.59 |
| CaO | 0.29 | 0.26 | 0.25 |
| MgO | 0.21 | 0.20 | 0.19 |
| MnO | 0.01 | 0.01 | 0.13 |
| $K_2O$ | 0.61 | 0.60 | 0.28 |

-continued

| | RESULTS IN % | | |
|---|---|---|---|
| ELEMENT | OUTER SURFACE | INNER SURFACE | SOILING |
| $Na_2O$ | 0.11 | 0.10 | 0.06 |
| ZnO | — | — | 0.4 |
| $ZrO_2$ | — | — | 0.10 |
| losses due to burning | 0.18 | 0.16 | 0.47:gaindue to burning |
| TOTAL | 99.78 | 99.80 | 99.53 |
| MINERALOGICAL PHASES | Sillimanite $Al_2O_3$, $SiO_2$ Cristobalite $SiO_2$ Andalusite $Al_2O_3$, $SiO_2$ Quartz $SiO_2$ (traces) | Sillimanite $Al_2O_3$, $SiO_2$ Cristabolite $SiO_2$ Andalusite $Al_2O_3$, $SiO_2$ Quartz $SiO_2$ (traces) | |

To ensure that the sleeve 54 possesses good flame integrity and good resistance to thermal shock, particularly when the furnace is being shut down and started up, the sleeve is made as follows.

The materials, in the form of granules, of which the structure of the sleeve is made are placed in a cylindrical mold that defines the shape of the sleeve, so as to produce a ramming mass.

The ensure correct sintering, the ramming mass is rammed or clamped in the mold very carefully, in particular adding successive layers 2 or 3 cm thick each, which are rammed into place using a pneumatic rammer.

The ramming mass is then baked using a standard temperature-rise profile specific to ramming masses, up to a temperature of 1350° C.

After baking and mold release, the ramming mass has the following properties:

| | |
|---|---|
| Base constituent | Chamotte |
| Mean expansion between 0 and 1000° C. | $3.10^6$ |
| Physical properties | |
| Density after heating to 1000° C. | 2.3 $T/m^3$ |
| Coefficient of conduction in kcal $m^2h°$ C. at | |
| 600° C. | 0.7 |
| 800° C. | 0.7 |
| 1200° C. | 1 |
| Resistance to compression when cold after heating to 1100° C. | 350 $kg/cm^2$ |
| Pyroscopic cone | 36 |
| Limit service temperature | 1500° C. |
| Collapse under a load of 2 bar | 0.5% at 1200° C. and 5% at 1340° C. |

The mounting means 56 are designed to allow the heat shield 54 to be moved relative to the wall of the furnace, between at least two positions which are spaced apart along the axis of the burner. For this purpose they comprise a guide tube 58, the inside diameter of which slightly exceeds the outside diameter of the main part 38A of the jacket. The tube 58 has, at its front end, a transverse annular plate 60 provided with drillings for attaching the shield 54. For this purpose, the latter has anchors 62, the threaded ends of which are passed through the drillings and held in place by nuts 64.

At its rear end, the tube 58 has an annular flange 66 drilled with a series of tapped holes. Pressed against this flange is an additional flange 68 held on the first flange 66 by screws 70 which form means of clamping the two flanges together along the axis of the burner.

The flange 68 has, on its inside diameter, and on its face which is in contact with the first flange 66, a counterbore 72 in which there is housed a gripping O-ring 74, the diameter of which approximately corresponds to the outside diameter of the main part 38A of the jacket. Thus, the O-ring 74 is in contact with the lateral surface of the jacket.

It will be understood that when the clamping means 70 are slackened off, as the O-ring 74 is no longer compressed, the tube 58 is free to slide axially along the main part 38A of the jacket from a withdrawn position depicted in FIG. 2 into a forward position depicted in FIG. 3. It carries with it the heat shield 54.

By contrast, when the clamping means 70 are holding the flange 68 against the flange 66, the O-ring 74 is compressed and exerts a frictional force on the main part 38A of the jacket, ensuring that the heat shield 54 is held in position. Thus, depending on the length of the sleeve 54, the position of the heat shield can be adjusted, so that the sleeve 54 projects from the lining 36 over a predetermined length. This length is advantageously of the order of 7 cm.

When the sleeve 54 is new, as depicted in FIG. 2, this sleeve is very long, for example 40 cm long. Thus, the mounting means 56 are held at the rear and most of the length of the sleeve 54 extends behind the lining 36.

While the burner is operating, the annular end face of the sleeve, which is contained inside the furnace, progressively degrades, particularly under the chemical of the molecules of oxides of iron and of manganese produced by the slag which comes off the molten iron.

With the composition and structure adopted for the refractory material of which the sleeve 54 is made, it is observed that the erosion of the front end of the sleeve occurs on a plane which extends at right angles to the axis of this sleeve. Thus, to keep the length of that part of the sleeve which projects from the lining 36 constant, the furnace operator periodically advances the sleeve to compensate for the amount of material that has been eroded from its end.

As depicted in FIG. 3, after a certain operating time, the mounting means 56 are almost completely housed inside the skirt 57 and the remaining length of sleeve is reduced to the thickness of the lining 36 and to the length that projects from this lining into the furnace.

It will be understood that with such a device the end of the burner is always correctly protected, the heat shield always extending beyond the ejection tip of the burner by the same amount.

Although the material of which the sleeve 54 is made experiences erosion, this erosion is slow enough that periodic adjustment of the position of the heat shield is sufficient to avoid degradation to the end of the burner.

Finally, the low cost of the sleeve allows it to be replaced several times during the life of the furnace without it having an appreciable impact on the latter's operating cost.

What is claimed is:

1. Device for protecting an ejection outlet of a burner mounted through a wall of a furnace, comprising a peripheral heat shield around the ejection outlet of the burner having a thermally consumable structure including a refractory material and a mounting for said heat shield including a moving means for moving the heat shield relative to the wall of the furnace in response to the thermal consumption of said structure, between at least two positions which are spaced apart along the axis of the burner.

2. Device according to claim 1, wherein the mounting is between the burner and the heat shield, such that the heat shield is borne by the burner.

3. Device according to claim 2, wherein the burner comprises a jacket including pipes conveying the fuel and the oxidizing agent, which jacket is tubular over at least part of its length, and wherein the mover has a guide member pushed over the tubular part of the jacket, so as to allow the heat shield to slide along the jacket.

4. Device according to claim 3, wherein the guide member comprises two coupled flanges trapping a gripping O-ring pressed against the exterior surface of the tubular part of the jacket, and a clamp for clamping the two flanges together so as to compress the O-ring, thus keeping the heat shield in position relative to the jacket of the burner.

5. Device according to claim 1, wherein the refractory material of which the thermally consumable structure is made is an aluminosilicate comprising, by mass, x % of $SiO_2$ and y % of $Al_2O_3$ with an x/y ratio of between one third and two thirds.

6. Device according to claim 5, wherein the sum x+y of the percentages by mas of $SiO_2$ and $Al_2O_3$ exceeds 90%.

7. Device according to claim 5 wherein said thermally consumable structure is a ramming mass which, prior to mounting, has been baked at a temperature in excess of 1000° C.

8. Device according to claim 5, wherein the ratio x/y is close to one half.

9. Heating device comprising a burner mounted through the wall of a furnace and a device for protecting the ejection outlet of the burner according to claim 1.

* * * * *